US010568396B2

(12) United States Patent
Hamada et al.

(10) Patent No.: US 10,568,396 B2
(45) Date of Patent: Feb. 25, 2020

(54) WOVEN MATERIAL INCLUDING BONDING FIBERS

(71) Applicant: Apple Inc., Cupertino, CA (US)

(72) Inventors: Yoji Hamada, Tokyo (JP); Peter F. Coxeter, Cupertino, CA (US); Ying-Liang Su, Tokyo (JP); Edward Siahaan, Cupertino (CA); Whitney D. Mattson, Cupertino, CA (US); Naoto Matsuyuki, Tokyo (JP)

(73) Assignee: APPLE INC., Cupertino, CA (US)

( * ) Notice: Subject to any disclaimer, the term of this patent is extended or adjusted under 35 U.S.C. 154(b) by 160 days.

(21) Appl. No.: 15/501,926

(22) PCT Filed: Jul. 12, 2015

(86) PCT No.: PCT/US2015/040077
§ 371 (c)(1),
(2) Date: Feb. 6, 2017

(87) PCT Pub. No.: WO2016/025110
PCT Pub. Date: Feb. 18, 2016

(65) Prior Publication Data

US 2017/0224064 A1 Aug. 10, 2017

Related U.S. Application Data

(63) Continuation of application No. 14/735,095, filed on Jun. 9, 2015, now abandoned.
(Continued)

(51) Int. Cl.
*A44C 5/00* (2006.01)
*A44C 27/00* (2006.01)
(Continued)

(52) U.S. Cl.
CPC ..... *A44C 5/0053* (2013.01); *A44C 27/001* (2013.01); *D03D 1/00* (2013.01);
(Continued)

(58) Field of Classification Search
None
See application file for complete search history.

(56) References Cited

U.S. PATENT DOCUMENTS 4,846,230 A 7/1989 Mock et al.
5,219,636 A 6/1993 Golz
(Continued)

FOREIGN PATENT DOCUMENTS

CN 202415821 U 9/2012
CN 103397429 A 11/2013
(Continued)

OTHER PUBLICATIONS

International Search Report issued in PCT/US2015/040077, dated Oct. 22, 2015.
(Continued)

*Primary Examiner* — Shawn Mckinnon
*Assistant Examiner* — Lashawanda T McKinnon
(74) *Attorney, Agent, or Firm* — Morgan, Lewis & Bockius LLP

(57) ABSTRACT

A woven material (100) including bonding fibers (108) and a method of reinforcing woven material using bonding fibers is disclosed. The woven material (100) includes a plurality of warp threads (102), and at least one weft thread (104) coupled to the warp threads (102). The woven material (100) also includes a plurality of bonding fibers (108). The bonding fibers (108) are positioned in parallel with the warp threads (102), and/or in parallel with the weft thread(s) (104). Additionally, the bonding fibers (108) are formed from a material having a melting temperature that is lower
(Continued)

than a melting temperature of the material(s) used to form the warp threads (102) and the weft thread(s) (104) of the woven material.

18 Claims, 13 Drawing Sheets

Related U.S. Application Data

(60) Provisional application No. 62/035,401, filed on Aug. 9, 2014.

(51) Int. Cl.

| | |
|---|---|
| ***D03D 11/00*** | (2006.01) |
| ***D03D 15/00*** | (2006.01) |
| ***D03D 1/00*** | (2006.01) |
| ***D03D 3/00*** | (2006.01) |

(52) U.S. Cl.

CPC ..... *D03D 3/005* (2013.01); *D03D 11/00* (2013.01); *D03D 15/00* (2013.01); *D10B 2321/022* (2013.01); *D10B 2331/02* (2013.01); *D10B 2331/04* (2013.01); *D10B 2331/10* (2013.01); *D10B 2401/041* (2013.01); *D10B 2403/032* (2013.01)

(56) References Cited

U.S. PATENT DOCUMENTS

| | | | | |
|---|---|---|---|---|
| 6,107,220 | A * | 8/2000 | Popper | A41D 31/0061 442/366 |
| 6,376,047 | B1 | 4/2002 | Hasegawa | |
| 2003/0056846 | A1 * | 3/2003 | Buesgen | B60R 21/18 139/1 R |

FOREIGN PATENT DOCUMENTS

| | | |
|---|---|---|
| EP | 0 036 527 A1 | 9/1981 |
| FR | 1.217.530 | 5/1960 |
| WO | WO 2009/059209 A2 | 5/2009 |

OTHER PUBLICATIONS

Notification of Reexamination from Chinese Application No. 201510482239.1 dated Oct. 31, 2018, 18 pages including English language translation.

* cited by examiner

WOVEN MATERIAL INCLUDING BONDING FIBERS

CROSS-REFERENCE TO RELATED APPLICATIONS

This Patent Cooperation Treaty patent application claims priority to U.S. Non-provisional patent application Ser. No. 14/735,095, filed Jun. 9, 2015, and titled "Woven Material Including Bonding Fibers," and U.S. Provisional Patent Application No. 62/035,401, filed Aug. 9, 2014 and titled "Woven Material Including Bonding Fibers," the disclosures of each of which are hereby incorporated herein by reference in their entirety.

FIELD

The disclosure relates generally to a woven material, and more particularly, to a woven material including bonding fibers and a method of reinforcing a woven material using bonding fibers.

BACKGROUND

Conventional woven material or fabric is used in a plurality of applications or industries. For example, woven material is used in clothing/apparel (e.g., shirts, pants, skirts, etc.), in fashion accessories (e.g., bracelets, watch bands, necklaces, etc.), in electronics (e.g., woven conductive layers, protective outer sheath for optical fiber cables), and other various industrial applications (e.g., rope, tape, protective gear, household/kitchenware, etc.). Due to the many uses and applications, conventional woven material is manufactured using specific material and/or manufactured to include specific physical properties. For example, where the woven material is used to form a bracelet or necklace, it may be desired that the woven material be flexible to contour around the surface in which the woven material is worn (e.g., wrist, neck). Additionally, it may be desired that the woven material forming the bracelet or necklace be durable, flexible and/or capable of withstanding typical wear/treatment of a bracelet or necklace. Furthermore, it may be desired that the woven material forming the bracelet or necklace be capable of forming unique designs or cosmetic embellishments including unique color patterns or portions having varied dimensions (e.g., tapered portions).

In order to form the unique designs or cosmetic embellishments, the threads (e.g., warp, weft) of the woven material are altered or adjusted. For example, in order to form a portion of a bracelet or necklace that includes a varied dimension, a tapered portion must be formed in the woven material. The tapered portion may be formed by increasing the distance between warp threads in the woven material, while continuing to weave the weft material through the warp threads. By increasing the distance between the warp threads of the woven material, the overall thickness or width of the woven material may also increase.

However, by increasing the distance in the warp threads of the woven material, the fiber density of the woven material in the tapered portion may decrease. As a result of the decrease in the fiber density in the tapered portion, the woven material becomes substantially less rigid in the tapered portion. This may ultimately result in the weakening of the woven material at the tapered portion, the undesired movement of the woven material at the tapered portion and/or an unwanted visual or cosmetic deformation of the woven material at the tapered portion.

SUMMARY

A woven material may include a plurality of warp threads, and at least one weft thread coupled to the plurality of warp threads. The woven material may also include a plurality of bonding fibers. The bonding fibers may be positioned in parallel with the plurality of warp threads, and/or in parallel with the at least one weft thread.

A method of reinforcing woven material. The method may include providing the woven material. The woven material may include a plurality of warp threads, and at least one weft thread coupled to the plurality of warp threads. The method may also include positioning a plurality of bonding fibers within at least a portion of the woven material, and melting the plurality of bonding fibers positioned within at least the portion of the woven material.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

The following disclosure relates to a woven material, and more particularly, to a woven material including bonding fibers, and a method of reinforcing a woven material using bonding fibers.

In a particular embodiment, the woven material may include bonding fibers positioned in parallel with a plurality of warp threads, and/or in parallel with at least one weft thread. The bonding fibers may be formed from a material having a melting temperature lower than the melting temperatures of the material forming the warp threads and weft threads of the woven material. As a result of the positioning and melting temperature of the bonding fibers within the woven material, the bonding fibers may be melted, without melting the warp threads and weft threads, to bond and/or reinforce the warp threads and weft threads of the woven material. That is, the bonding fibers woven into the woven material may be melted to substantially bond the warp threads and weft threads, and ultimately may increase the rigidity of the woven material. Where woven material is used to form a structure that includes a tapered portion, bonding fibers may be included in the tapered portion of the woven material, and may be melted to increase the rigidity of the tapered portion of the woven material. Furthermore, the bonding fibers may be positioned within or adjacent to the exterior surface of the woven material, and may not be visible. As such, the cosmetic effect of the exterior surface is unaffected by the melting of the bonding fibers within the woven material.

These and other embodiments are discussed below with reference to FIGS. 1-10. However, those skilled in the art will readily appreciate that the detailed description given herein with respect to these Figures is for explanatory purposes only and should not be construed as limiting.

Figure 1:
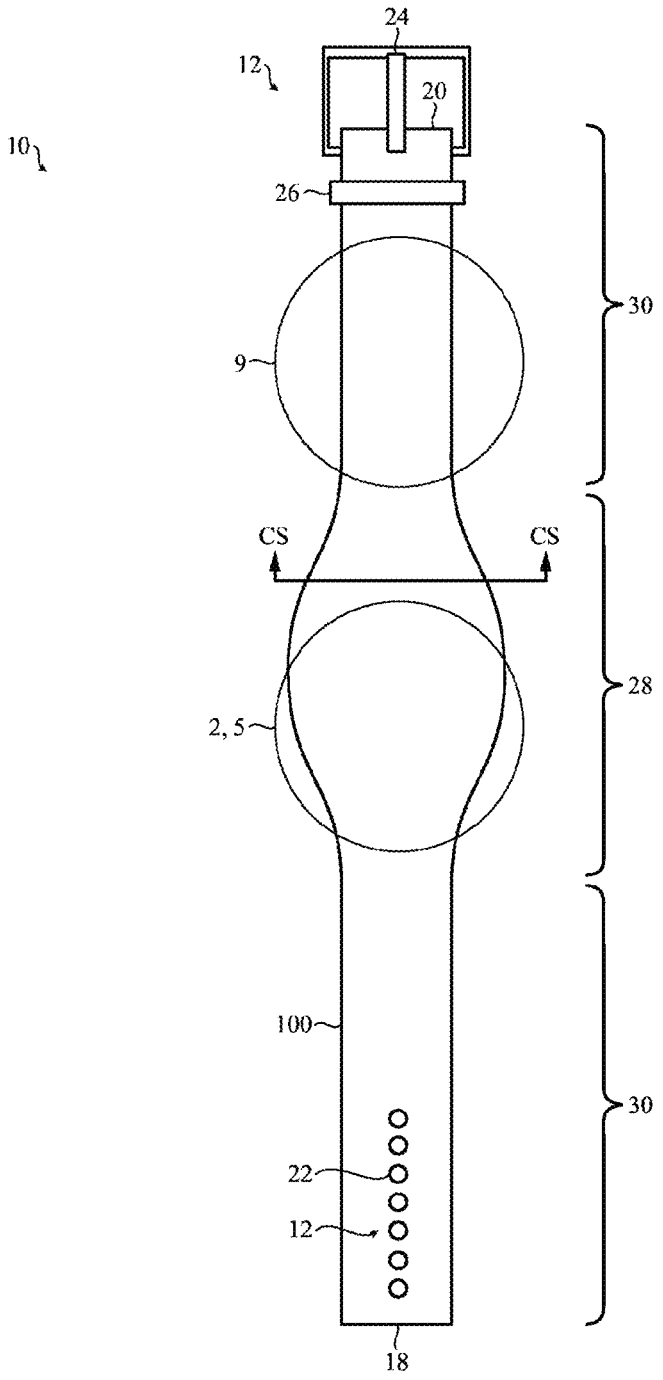
FIG. 1 shows an illustrative front view of a wearable band formed from a woven material, according to embodiments.

FIG. 1 shows an illustrative front view of a wearable band 10 including woven material 100, according to embodiments. In non-limiting examples, wearable band 10 may include a decorative band (e.g., wristband, armband, headband, necklace, etc.), a watch band, and a wearable band for holding an electronic device including, but not limited to: a smartphone, a gaming device, a display, a digital music player, a wearable computing device or display, and a health monitoring device. As shown in FIG. 1, wearable band 10 may include a watch band.

Wearable band 10 may include coupling component 12 positioned at distinct ends 18, 20 of wearable band 10. Coupling component 12 may be included within wearable band 10 to coupled ends 18, 20 and/or secure wearable band 10 to a user. Coupling component 12 may be any suitable coupling mechanism or embodiment capable of releasably coupling ends 18, 20 of wearable band 10. In a non-limiting example, as shown in FIG. 1, coupling component 12 includes a plurality of holes 22 formed through wearable band 10 adjacent end 18, and a buckle clasp 24 positioned at end 20. When wearable band 10 is worn by a user, end 18 is positioned through engagement buckle clasp 24, such that a portion of buckle clasp 24 may be positioned within one of the plurality of holes 22 formed through wearable band 10 to secure wearable band 10. End 18 may be further secured to wearable band 10 using reed loop 26 positioned substantially around wearable band 10. Reed loop 26 may include an opening (not shown) located between wearable band 10 and reed loop 26 configured to receive end 18 and/or position end 18 against a portion of wearable band 10. As discussed herein, reed loop 26 may also be made from woven material 100. By making both wearable band 10 and reed loop 26 from woven material 100, the cost and/or time of manufacturing wearable band 10 including reed loop 26 may be substantially reduced.

In another non-limiting example, not shown, coupling component 12 may be a hook and loop fastener system positioned at end 18, and a ring positioned at end 20. When wearable band 10 is worn by a user, end 18 is positioned through the ring and folded, such that hook portion may contact and/or be coupled to loop portion of the fastener system, to secure wearable band 10 to the user.

As shown in FIG. 1, wearable band 10 may include a tapered portion 28 positioned between end 18 and end 20. More specifically, tapered portion 28 may be positioned between uniform portions 30 of wearable band 10, where tapered portion 28 includes a varying width in wearable band 10, and uniform portions 30 include a uniform width in wearable band 10. As discussed herein, woven material 100 may form tapered portion 28 in wearable band 10. Tapered portion 28 may be included within wearable band 10 based on, at least in part, the function and/or intended use of wearable band 10. In a non-limiting example where wearable band 10 includes a watch band, tapered portion 28 may be included in wearable band 10 to position and/or secure a watch casing including a display (not shown) on wearable band 10. In an additional non-limiting example, where wearable band 10 includes a band for holding an electronic device, tapered portion 28 may provide additional surface area for holding and/or coupling the electronic device to wearable band 10. In a further non-limiting example, where wearable band 10 includes a decorative band, tapered portion 28 may provide additional space to provide a visually appealing decorative element or item (e.g., logo, jewel, graphic, etc.).

Although shown substantially in the center or middle of wearable band 10, it is understood that wearable band 10 may include one or more tapered portions 28 included in end(s) 18, 20. In a non-limiting example, tapered portions 28 may be included at end(s) 18, 20 to aid in securing the coupling component 12 to the wearable band 10 and/or to aid in the ease of inserting end 18 into and/or coupling end 18 to coupling component 12. Additionally, tapered portion 28 may include a converging taper. In a non-limiting example, and distinct from FIG. 1 which shows tapered portion 28 as a diverging or widening taper, tapered portion 28 may include a portion of woven material 100 that may converge and/or may have a width smaller than the width of the uniform portions 30 of wearable band 10.

Figure 2:
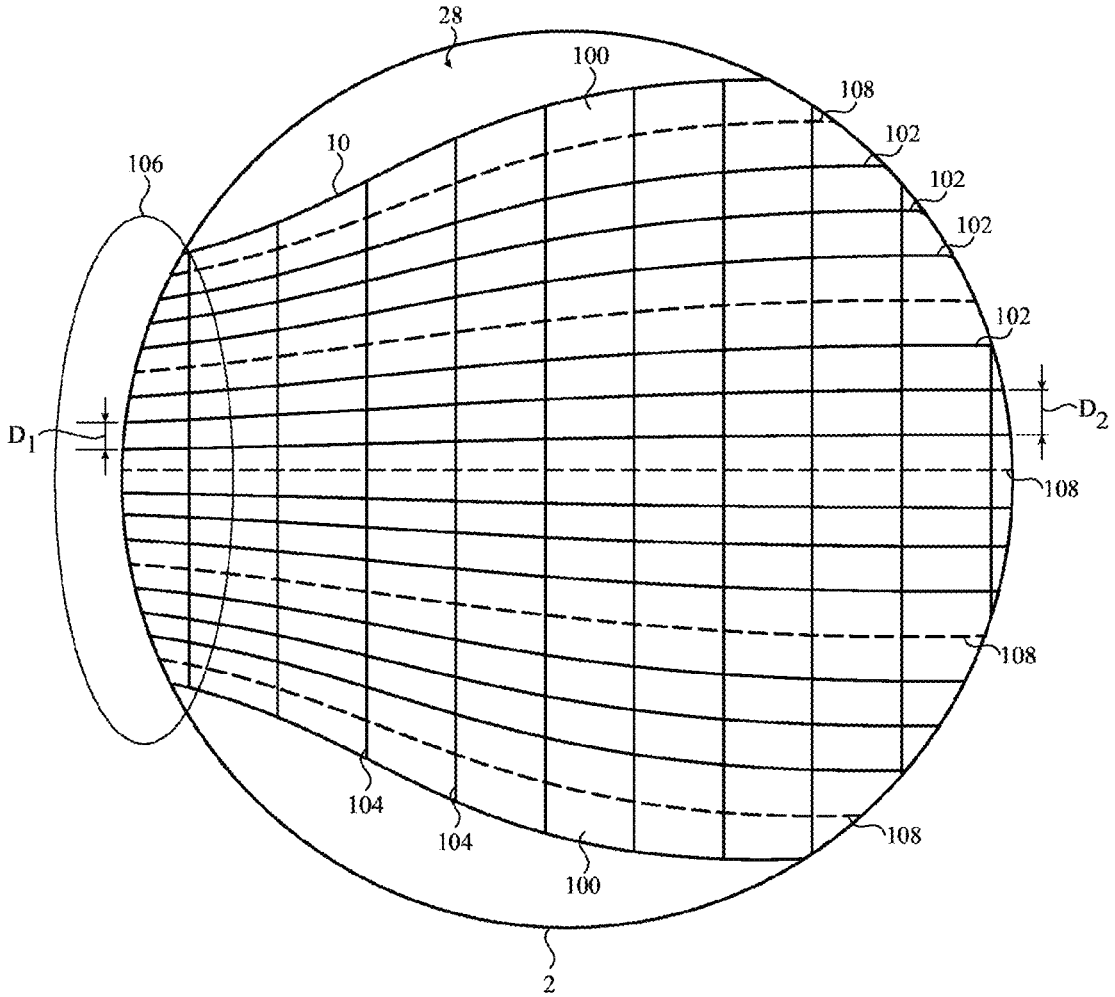
FIG. 2 shows an enlarged tapered portion of the wearable band including woven material as depicted in FIG. 1, according to embodiments.

FIG. 2 shows an enlarged portion 2 of wearable band 10 including woven material 100, as depicted in FIG. 1. More specifically, FIG. 2 shows an enlarged view of a portion of tapered portion 28 of wearable band 10 formed from woven material 100. Woven material 100 of wearable band 10 may include a plurality of warp threads 102 and at least one weft thread 104 coupled to the plurality of warp threads 102. More specifically, woven material 100 may include the plurality of warp threads 102 positioned along the length of wearable band 10, and at least one weft thread 104 positioned perpendicular to, and coupled to, woven or interlaced between the plurality of warp threads 102. It is understood that the plurality of warp threads 102 may run the entire length of woven material 100 forming wearable band 10. Additionally, it is understood that the at least one weft thread 104 may include a single thread that may be continuously woven between the plurality of warp threads 102, or may include a plurality of threads that may be woven between the plurality of warp threads 102. The weft thread 104 woven between the plurality of warp threads 102 may form consecutive cross layers with respect to the plurality warp threads 102 in order to form woven material 100. Woven material 100, as discussed herein, may be formed using a suitable weaving technique and/or weaving machinery. In a non-limiting example, woven material 100 may be formed using a dobby loom.

It is understood that similarly named components or similarly numbered components may function in a substantially similar fashion, may include similar materials and/or may include similar interactions with other components. Redundant explanation of these components has been omitted for clarity.

Additionally, it is understood that the number of threads shown in FIG. 2 to form woven material 100 may be merely exemplary. That is, the number of warp threads 102 and weft threads 104 shown in FIG. 2 may be merely exemplary for clearly and completely describing the disclosure, and may not represent the actual number of warp threads 102 and/or weft threads 104 used to form woven material 100. In a non-limiting example, woven material 100 may be formed from more than 200 warp threads 102 and a single weft thread 104 coupled to, woven or interlaced between the plurality of warp threads 102.

The warp threads 102 and the weft thread 104 may be formed from or include a polyamide (e.g., nylon) material, a polyester material or a polypropylene material. Warp threads 102 and weft thread 104 of woven material 100 may also be formed from any other suitable polymer material that may include similar physical characteristics as polyester and/or polypropylene. As discussed herein, the material forming warp threads 102 and weft threads 104 may also include melting temperatures between approximately 180° C. and approximately 260° C. Warp threads 102 and weft thread 104 may be formed from the same material or may include distinct materials when forming woven material 100.

As shown in FIG. 2, tapered portion 28 of woven material 100 forming wearable band 10 may be formed as a result of increasing the distance (D) between the warp threads 102 of woven material 100. That is, in order to form tapered portion 28 of wearable band 10, the overall width of woven material 100 is increased by increasing the distance (D) between each of the plurality of warp threads 102. As shown in FIG. 2, the portion 106 of woven material 100 not included in tapered portion 28 may include a first distance ($D_1$) between each warp thread 102. In comparison, the portion of the warp threads 102 forming tapered portion 28 of woven material 10 may include a second distance ($D_2$) between each warp thread 102, where the second distance (D2) is greater than the first distance ($D_1$).

By increasing the distance (D) between each of the plurality of warp threads 102 to form tapered portion 28, the fiber density of woven material 100 may be decreased in tapered portion 28, which may ultimately make woven material 100 less rigid at tapered portion 28. To provide additional rigidity to tapered portion 28, woven material 100 may also include a plurality of bonding fibers 108 (shown in phantom). As shown in FIG. 2, the plurality of bonding fibers 108 may be positioned in parallel with the plurality of warp threads 102. More specifically, the plurality of bonding fibers 108 may be positioned in parallel with the warp threads 102 and may be positioned within tapered portion 28 of woven material 100. As a result of forming the plurality of bonding fibers 108 in parallel with the warp threads 102, the bonding fibers 108 may be positioned along the entire length of wearable band 10 formed from woven material 100. As discussed herein, the plurality of bonding fibers 108 may also be positioned in parallel with the at least one weft thread 104 (see, FIG. 5). Additionally, it is understood that woven material 100 may include bonding fibers 108 positioned in parallel with the plurality of warp threads 102 and in parallel with the at least one weft thread 104 (see, FIG. 7).

The plurality of bonding fibers 108 are shown in phantom as a result of bonding fibers 108 being positioned within woven material 100 and/or wearable band 10. That is, and as discussed herein, the bonding fibers 108 may be substantially surrounded by the warp threads 102 and the weft thread 104 of woven material 100, such that bonding fibers 108 are not visible and/or included in the exterior surface of wearable band 10 formed from woven material 100. However, and as discussed herein, the plurality of bonding fibers 108 may be positioned in and/or may be exposed on an exterior surface of woven material 100 (see, FIG. 4A).

The plurality of bonding fibers 108, as shown in FIG. 2, may be formed from or include a polyamide (e.g., nylon) material, a polyester material, a polypropylene material or a thermoplastic polyurethane. The material forming bonding fibers 108 may also include a melting temperature substantially lower than the melting temperature of the material forming the warp threads 102 and the melting temperature of the material forming the at least one weft thread 104. In a non-limiting example, the melting temperature for the plurality of bonding fibers 108 may be between approximately 90° C. and approximately 160° C. As discussed herein, by including a melting temperature substantially lower than the melting temperature of the remainder of the material (e.g., warp thread 102, weft thread 104) of woven material 100, the bonding fibers 108 may be melted without altering the physical appearance and/or characteristics of the rest of woven material 100. Additionally as discussed herein, the melting of the bonding fibers 108 may provide rigidity to woven material 100 forming wearable band 10.

Figure 3A:
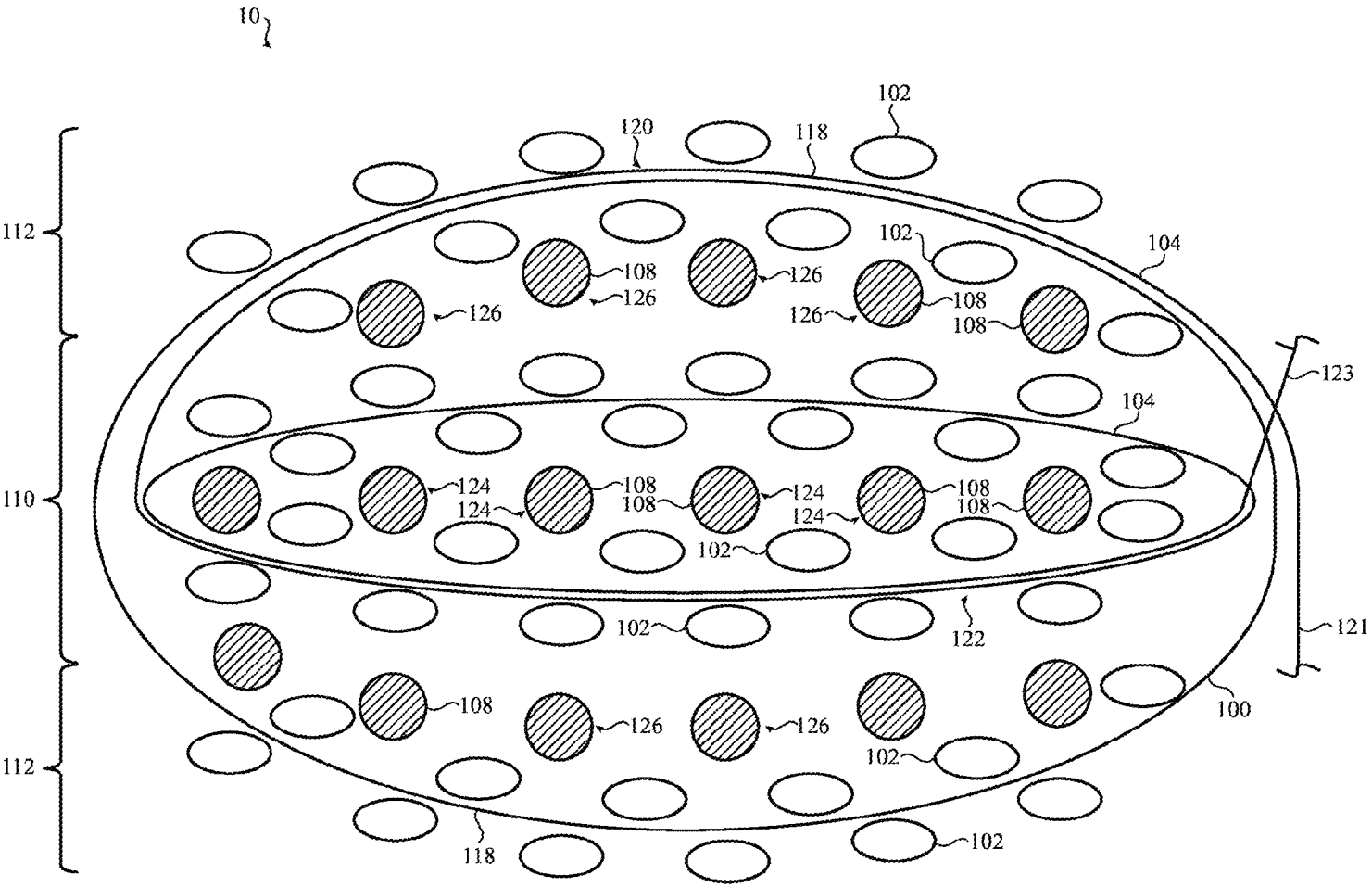
FIG. 3A shows a cross-section view of a portion of the wearable band of FIG. 1 taken along line CS, according to embodiments.

FIG. 3A shows a cross-section view of a portion of the wearable band 10 of FIG. 1 taken along line CS. The cross-section view of FIG. 3A may be taken at a crossing of woven material 100 prior to the transition or position change of the warp threads within the woven material 100. That is, and as discussed herein, the plurality of warp threads may be coupled to, or continuously woven with (e.g., above, below) at least one weft thread to form woven material 100. As such, in the cross-section of woven material 100 in FIG. 3A, the warp threads are depicted as being in an instantaneous position about the weft thread, prior to and/or subsequent to the warp threads being woven through the weft thread. It is understood that the position of the warp threads in FIG. 3A is not permanent, and/or the warp threads are not fixed in the depicted position.

It is also understood that the number of threads shown in FIG. 3A to form woven material 100 may be merely exemplary, and may not represent the actual number of warp threads and/or weft threads used to form woven material 100. In a non-limiting example, woven material 100 may be formed from more than 200 warp threads and a single weft thread coupled to, woven or interlaced between the plurality of warp threads. In conjunction, the spacing between the warp threads and/or weft threads as shown in FIG. 3A may also be merely exemplary for the purpose of clearly and completely describing woven material 100. It is understood that the space between the threads of woven material 100 may only be large enough to couple and/or weave at least one weft thread through the plurality of warp threads (e.g., 200 warp threads) to form woven material 100. Additionally, the spacing between the threads of woven material 100 may be substantially minimal such that a user may not be able to see through woven material 100.

As discussed herein, wearable band 10 may be formed from woven material 100 including a plurality of warp threads 102 and at least one weft thread 104. Woven material 100 may include a first group 110 of warp threads 102, and a second group 112 of warp threads 102 substantially surrounding first group 110 of warp threads 102. That is, first group 110 of warp threads 102 may form an inner portion of woven material 100, and second group 112 of warp threads 102 may form an outer portion or an exterior surface 118 of woven material 100. The first group 110 of warp threads 102 may not be seen by a user of wearable band 10, and the second group 112 of warp threads 102 forming exterior surface 118 of woven material 100 may be seen by the user of wearable band 10.

Additionally, as shown in FIG. 3A, woven material 100 may include a single weft thread 104 coupled to, woven or interlaced between first group 110 and second group 112 of warp threads 102. More specifically, the single weft thread 104 may include an exterior weft thread portion 120 coupled to the second group 112 of warp threads 102, and an interior weft thread portion 122 coupled to the first group 110 of warp threads 102. As a result of weft thread 104 being a single thread, exterior weft thread portion 120 and interior weft thread portion 122 may include, in part, a double weave or thickness of weft thread 104 when forming woven material 100, as shown in FIG. 3A. By including first group 110 and second group 112 of warp threads 102, and exterior weft thread portion 120 and interior weft thread portion 122 of weft thread 104, woven material 100 may not include the need for filler material (see, FIG. 4A), and/or may not include additional structure support and/or stiffness.

Weft thread 104 may be continuously woven through and/or coupled to warp threads 102 to form the various layers or rows of woven material 100. That is, and as discussed herein, woven material 100 may be formed by coupling or continuously weaving weft thread 104 through the warp threads 102 to form various layers of weft thread 104 woven through the plurality of warp threads 102. As such, and as shown in FIG. 3A, weft thread 104 of woven material 100 may include a prior layer portion 121, which may form the beginning of weft thread 104 for the displayed or current layer, and a subsequent layer portion 123 positioned opposite prior layer portion 121. Prior layer portion 121 may include a portion of weft thread 104 that may be included in the prior layer of woven material 100, and previously woven through the warp threads 102. Conversely, subsequent layer portion 123 of weft thread 104 may be woven through the warp threads 102 of the displayed or current layer of woven material 100, and may be positioned to be subsequently woven through the subsequent layer of woven material 100.

Bonding fibers 108 may also be formed in woven material 100, as shown in FIG. 3A. The plurality of bonding fibers 108 of woven material 100 may include a first collection 124 of bonding fibers 108 substantially surrounded by the first group 110 of warp threads 102. As shown in FIG. 3A, the first collection 124 of bonding fibers 108 may also be positioned within interior weft thread portion 122 of single weft thread 104 of woven material 100. That is, the first collection 124 of bonding fibers 108 may be positioned within woven material 100 between the warp threads 102 and may not be coupled to the single weft thread 104 of woven material 100. As such, the first collection 124 of bonding fibers 108 may be contained within an inner portion of woven material 100, and may not be seen by a user of wearable band 10. The first collection 124 of bonding fibers 108 may include substantially similar characteristics as the bonding fibers 108 discussed herein with respect to FIG. 2. For example, the first collection 124 of bonding fibers 108 may be formed from a material having a melting temperature substantially lower than the melting temperature of the material forming the warp threads 102 and the melting temperature of the material forming the weft thread 104.

Additionally as shown in FIG. 3A, the plurality of bonding fibers 108 may also include a second collection 126 of bonding fibers 108 positioned between the first group 110 of warp threads 102 and the second group 112 of warp threads 102. The second collection 126 of bonding fibers 108 may also be positioned between the interior weft thread portion 122 and the exterior weft thread portion 120, and may be substantially surrounded by the exterior weft thread portion 120. Similar to the first collection 124, the second collection 126 of bonding fibers 108 may not be coupled to the single weft thread 104 of woven material 100. Additionally, as a result of the positioning of the second collection 126 of bonding fibers 108 within woven material 100, the second collection 126 of bonding fibers 108 may not be positioned on the exterior surface 118 of wearable band 10, and/or may not be seen by a user of wearable band 10. Like the first collection 124 of bonding fibers 108, the second collection 126 of bonding fibers 108 may include substantially similar characteristics as the bonding fibers 108 discussed herein with respect to FIG. 2. That is, the second collection 126 of bonding fibers 108 may be formed from a material having a melting temperature substantially lower than the melting temperature of the material forming the warp threads 102 and the melting temperature of the material forming the weft thread 104. Additionally, first collection 124 and second collection 126 of bonding fibers 108 may include substantially similar or distinct materials, so long as the melting temperature for each material is lower than the melting temperature of the materials of the other components (e.g., warp thread 102, weft thread 104) forming woven material 100.

As discussed herein, the bonding fibers 108 may be formed from a material having a melting temperature substantially lower than the melting temperature of the material forming the plurality of warp threads 102 and the at least one weft thread 104 of woven material 100. As a result, bonding fibers 108 may be substantially melted within woven material 100 without negatively effecting (e.g., melting) the plurality of warp threads 102 and the at least one weft thread 104.

Figure 3B:
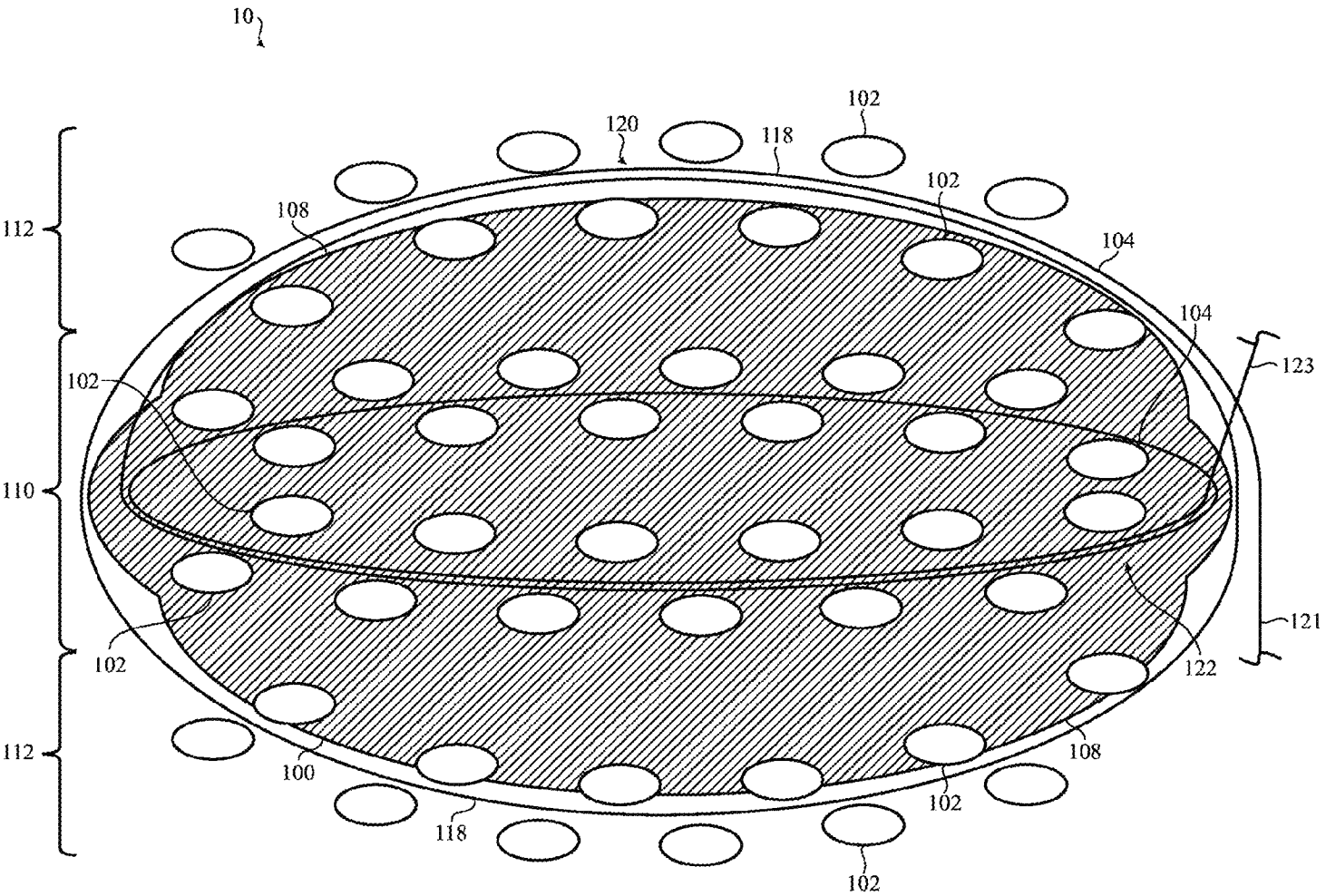
FIG. 3B shows a cross-section view of a portion of the wearable band of FIG. 1 taken along line CS after a melting process is performed, according to embodiments.

FIG. 3B shows a cross-section view of a portion of the wearable band 10 of FIG. 1 taken along line CS, after a melting process has been performed. As shown in FIG. 3B, bonding fibers 108 may be substantially melted within woven material 100, and may form a bond between the warp threads 102 and/or weft thread 104 of woven material 100. More specifically, bonding fibers 108 may be melted within woven material 100 to form bonds between the warp threads 102 and/or weft thread 104 of woven material 100, without melting, or more generally, changing the characteristics (e.g., strength, position, state, etc.) of warp threads 102 and weft thread 104. The first collection 124 of bonding fibers 108 may substantially bond the first group 110 of warp threads 102 that may be substantially surrounding the first collection 124 of bonding fibers 108. More specifically, as shown in FIG. 3B, when melted, the first collection 124 of bonding fibers 108 may substantially bond the first group 110 of warp threads 102, and interior weft thread portion 122 of the single weft thread 104, which may also substantially surround the first collection 124.

Additionally, second collection 126 of bonding fibers 108 may substantially bond the second group 112 of warp threads 102 of woven material 100. More specifically, as shown in FIG. 3B, when melted, the second collection 126 of bonding fibers 108 may substantially bond the second group 112 of warp threads 102, and exterior weft thread portion 120 of the single weft thread 104 of woven material 100. Furthermore, second collection 126 of bonding fibers 108 may substantially bond first group 110 of warp threads 102 to the second group 112 of warp threads 102. That is, as a result of positioning the second collection 126 of bonding fibers 108 between the first group 110 and second group 112 of warp threads 102, the second collection 126 of bonding fibers 108 may form a bond between the first group 110 and second group 112 of warp threads 102. This bond between the first group 110 and second group 112 of warp threads 102 formed by the second collection 126 of bonding fibers 108 may negate the need for a connection yarn (not shown) to be formed within woven material 100. The connection yarn of woven material 100 may connect or couple the inner portion (e.g., first group 110 of warp threads 102, interior weft thread portion 122 of single weft thread 104) of woven material 100 to the outer portion (e.g., second group 112 of warp threads 102, exterior weft thread portion 120 of single weft thread 104) or exterior surface 118 of woven material 100. In a non-limiting example, not shown, second collection 126 of bonding fibers 108 may not form a bond between the first group 110 and second group 112 of warp threads 102. In this example, a connection yarn may be formed within woven material 100 to connect or couple the inner portion and the outer portion of exterior surface 118 of woven material 100.

As discussed herein, bonding fibers 108 may be melted within woven material 100 by exposing wearable band 10 to an external heat source (not shown). The heat source may heat the woven material 100 forming wearable band 10 to a temperature above the melting temperature of the material forming bonding fibers 108, but substantially below the melting temperature of the materials forming warp threads 102 and weft threads 104. In a non-limiting example, bonding fibers 108 may be formed from a nylon (e.g., polyamide) material which includes a melting temperature of 100° C., and the warp threads 102 and weft thread 104 may be formed from a polyester material including a melting temperature of 180° C. In the example, in order to melt bonding fibers 108, without substantially melting the warp threads 102 and weft thread 104, woven material 100 forming wearable band 10 may be exposed to an external heating source (not shown) which may raise the temperature of the woven material to 105° C. As such, after a predetermined period of time, bonding fibers 108 may be substantially melted, while warp threads 102 and weft thread 104 of woven material may be substantially unaffected.

The bonding of the components (e.g., warp threads 102, weft thread 104) of woven material 100 may be dependent, at least in part, on the characteristics of bonding fibers 108 and/or the process of melting bonding fibers 108. For example, the bonds formed between the components of woven material 100, may be dependent, at least in part on: the size/dimensions of bonding fibers 108, the number of bonding fibers 108 positioned within woven material 100, the positioning of bonding fibers 108 within woven material 100, the physical/chemical characteristics (e.g., expansion characteristics) of the material forming bonding fibers 108, the exposure time to the external heat source, the temperature of the external heat source, the size/dimensions/quantity/formation of the woven material 100 and its components (e.g., warp threads 102, weft thread 104), etc.

By melting bonding fibers 108 to form bonds between the plurality of warp threads 102 and/or the at least one weft thread 104, woven material 100 may be provided with an increased stiffness and rigidity. More specifically, by melting bonding fibers 108 formed within tapered portion 28 of woven material 100, as shown in FIGS. 1-3B, the plurality of warp threads 102 and/or the at least one weft thread 104 of woven material may be substantially bonded together, which may result in additional stiffness and/or rigidity for woven material 100. This may be substantially beneficial in tapered portion 28 of woven material 100, which may be formed by increasing the distance between warp threads 102 and ultimately decreasing the fiber density for woven material 100, as discussed herein. That is, the bonds formed within tapered portion 28 of woven material 100 by melting bonding fibers 108 may substantially increase the rigidity or stiffness of woven material 100 at tapered portion 28, and may ultimately minimize or eliminate the negative effects or aspects (e.g., weakening, undesired movement, visual or cosmetic deformation) associated with forming tapered portion 28 within woven material 100, as discussed herein.

Figure 4A:
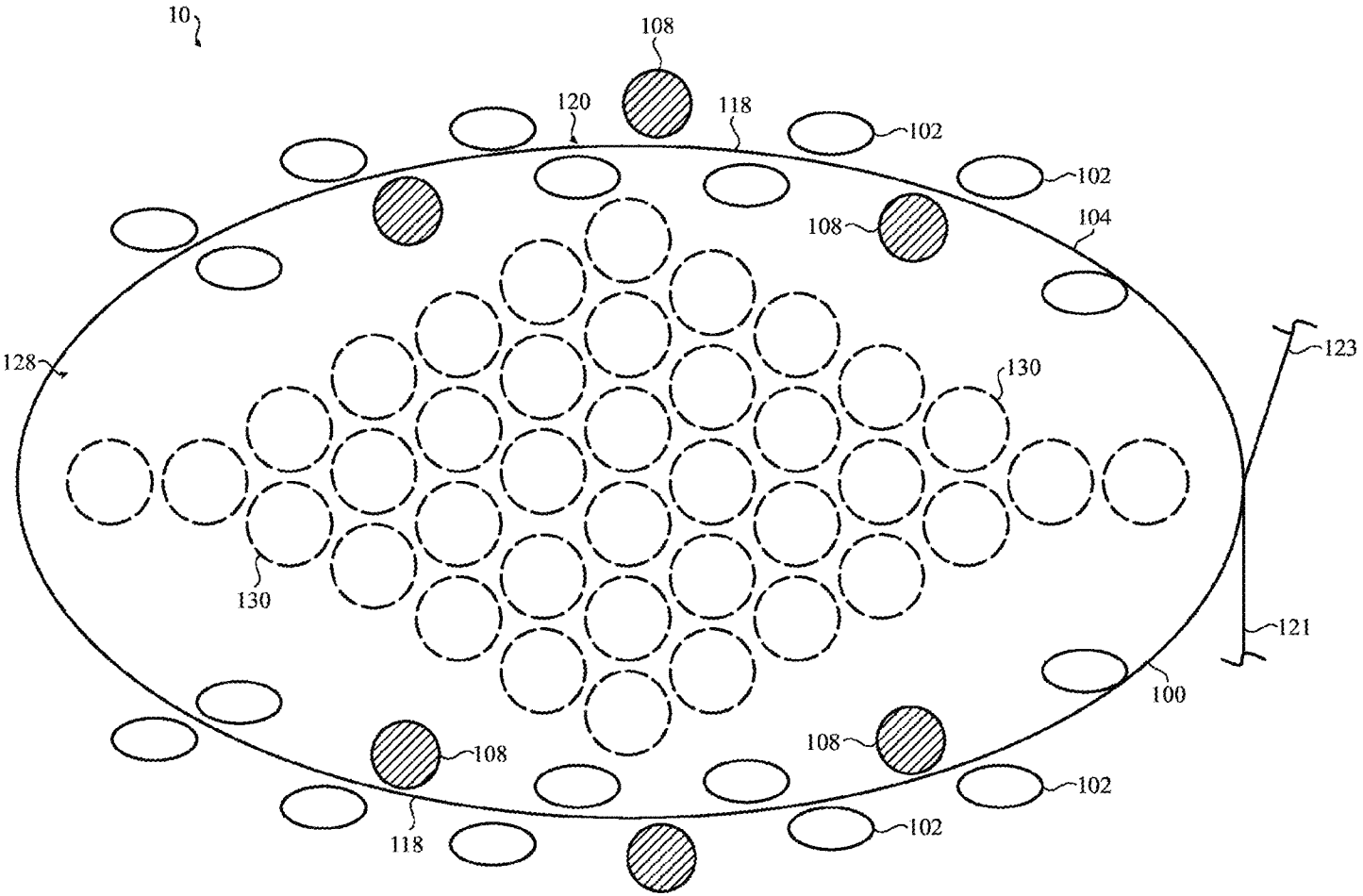
FIG. 4A shows a cross-section view of a portion of the wearable band of FIG. 1 taken along line CS, according to additional embodiments.

FIG. 4A shows a cross-section view of a portion of the wearable band 10 of FIG. 1 taken along line CS, in accordance with another embodiment. As shown in FIG. 4A, and with comparison to FIG. 3A, wearable band 10 may include a single layer band formed from woven material 100. More specifically, wearable band 10 may only be formed from second group 112 of warp threads 102 and exterior weft thread portion 120 of weft thread 104. As a result, woven material 100 may include an opening 128 formed through wearable band 10. As shown in FIG. 4A the opposite exterior surfaces 118 of woven material 100 may be separated and/or substantially surround opening 128 included within woven material 100. Woven material 100 including opening 128 may include optional filler fibers 130 (shown in phantom) positioned within opening 128. As shown in FIG. 4A, filler fibers 130 may be positioned in parallel to the warp threads 102 of woven material 100 and may be substantially surrounded and/or contained within woven material 100 by the plurality of warp threads 102 and weft thread 104. Additionally, filler fibers 130 may not be woven into woven material 100 or the various components (e.g., warp threads 102, weft thread 104) forming woven material 100. Rather, filler fibers 130 may be positioned within woven material 100 to provide additional support and/or structure to wearable band 10 formed from woven material 100 by filling opening 128 of woven material 100.

Where woven material 100 includes opening 128, bonding fibers 108 may be positioned on exterior surface 118 of woven material 100. More specifically, as shown in FIG. 4A, where woven material 100 includes opening 128 and only second group 112 of warp threads 102 and exterior weft thread portion 120 of weft thread 104, bonding fibers 108 may be positioned on exterior surface 118 of woven material 100. Bonding fibers 108, as shown in FIG. 4A, may be positioned parallel and/or integral with the plurality of warp threads 102 of woven material 100. That is, bonding fibers 108 may be positioned adjacent to and within the plurality of warp threads 102 used to form woven material 100. As such, and distinct from FIG. 3A, weft thread 104 of woven material 100 may be coupled to bonding fibers 108 as well as the warp threads 102. More specifically, as shown in FIG.

4A, weft thread 104 may be coupled to, woven or interlaced between the warp threads 102 and bonding fibers 108 positioned on exterior surface 118 of woven material 100. Weft thread 104 may be coupled to bonding fibers 108 in a substantially similar fashion or using a similar technique as coupling weft thread 104 to the plurality of warp threads 102, as discussed herein. As similarly discussed herein with respect to FIGS. 3A and 3B, and discussed in detail below, bonding fibers 108 may be positioned on exterior surface 118 of woven material 100, and coupled to weft thread 104 to substantially increase the rigidity or stiffness of woven material 100 at tapered portion 28 (see, FIGS. 1 and 2).

Bonding fibers 108 positioned on exterior surface 118 of woven material 100, as shown in FIG. 4A, may be formed from or include a substantially transparent material. More specifically, bonding fibers 108 positioned on exterior surface 118 of woven material 100 may be formed from or include a substantially transparent material including a polyamide (e.g., nylon) material, a polyester material, a polypropylene material or a thermoplastic polyurethane. Where bonding fibers 108 are positioned on exterior surface 118, it may be desired to form bonding fibers 108 from a transparent material, so that bonding fibers 108 do not disrupt the pattern or cosmetics of wearable band 10 formed by the plurality of warp threads 102 and/or weft thread 104. That is, by forming bonding fibers 108 from a transparent material, bonding fibers 108 unmelted or melted, as discussed herein with respect to FIG. 4B, may not undesirably change the pattern and/or color of woven material 100 forming wearable band 10.

Figure 4B:
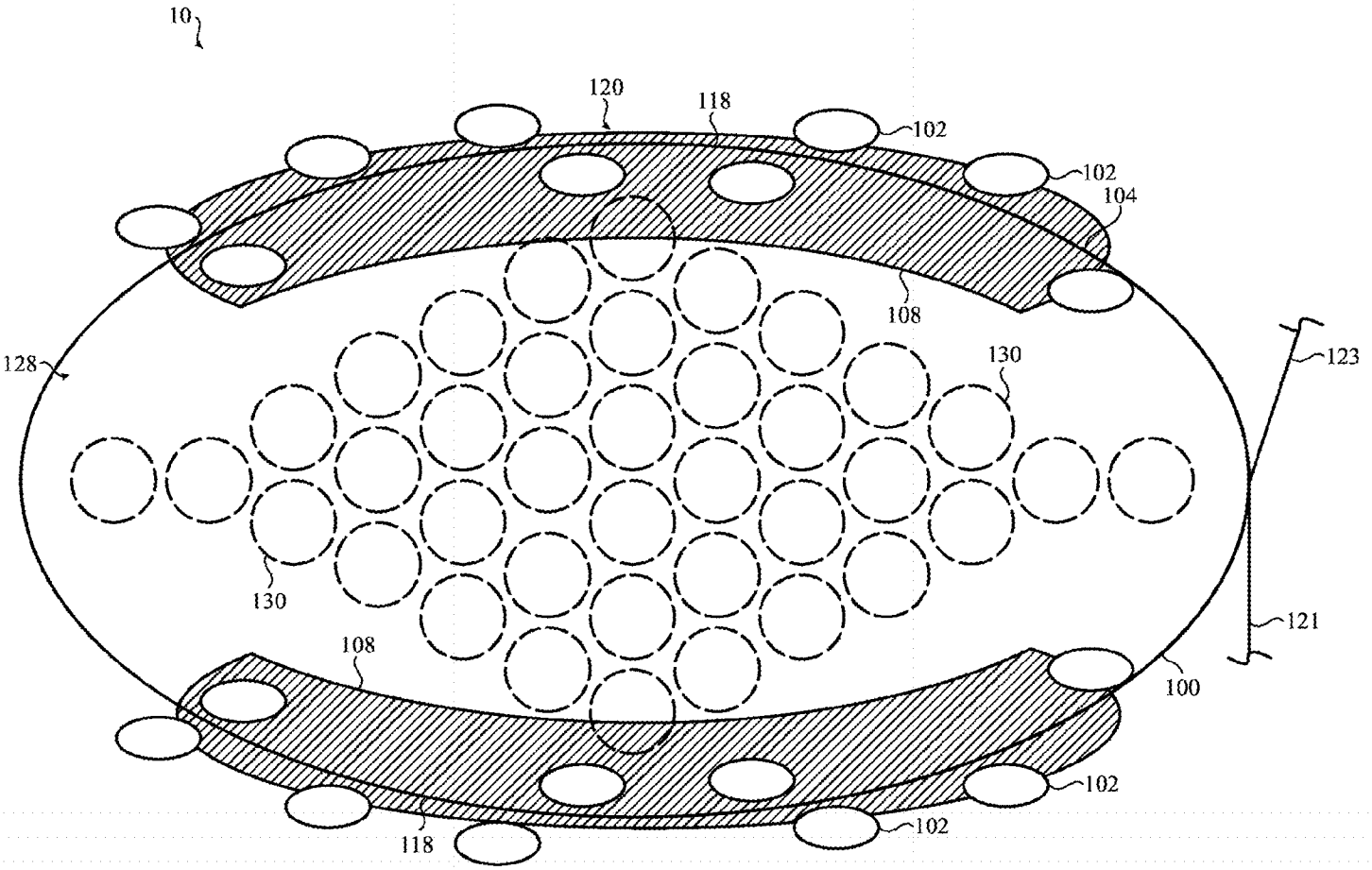
FIG. 4B shows a cross-section view of a portion of the wearable band of FIG. 1 taken along line CS after a melting process is performed, according to additional embodiments.

Similar to FIG. 3B, FIG. 4B shows a cross-section view of a portion of the wearable band 10 of FIG. 1 taken along line CS, after a melting process has been performed. As discussed herein, woven material 100 forming wearable band 10, as shown in FIG. 4B, may only include second group 112 of warp threads 102, exterior weft thread portion 120 of weft thread 104, and (melted) bonding fibers 108 substantially surrounding opening 128. As shown in FIG. 4B, bonding fibers 108 may be substantially melted within woven material 100, and may form a bond between the warp threads 102 and/or weft thread 104 of woven material 100. More specifically, bonding fibers 108 may be melted within woven material 100 to form bonds between the second group 112 of warp threads 102 and/or exterior weft thread portion 120 of weft thread 104 of woven material 100, without melting, or more generally, changing the characteristics (e.g., strength, position, state, etc.) of warp threads 102 and weft thread 104. In a non-limiting example, bonding fibers 108 may also be melted to bond a portion of the filler fibers 130 (shown in phantom) to warp threads 102 and/or weft threads 104 forming exterior surface 118 of woven material 100.

As similarly discussed herein with respect to FIG. 3B, bonding fibers 108, as shown in FIG. 4B, may be melted within woven material 100 by exposing wearable band 10 to an external heat source (not shown), and heating the woven material to a temperature above the melting temperature of the material forming the bonding fibers 108. Additionally as discussed herein, the woven material may also be heated to a temperature substantially below the melting temperature of the material forming the warp threads 102 and weft threads 104 to ensure warp threads 102 and weft thread 104 are not melted along with bonding fibers 108. The bonding of the components (e.g., warp threads 102, weft thread 104) of woven material 100 as shown in FIG. 4B may be dependent, at least in part, on the characteristics of bonding fibers 108 and/or the process of melting bonding fibers 108, as discussed herein.

By positioning bonding fibers 108 on exterior surface 118 of woven material 100, and subsequently melting bonding fibers 108, wearable band 10 formed from woven material 100 may include an increased stiffness and rigidity, as discussed herein. More specifically, by positioning and subsequently melting bonding fibers 108 on exterior surface 118, woven material 100 may be provided with additional stiffness and rigidity, as a result of the melted bonding fibers 108 forming a hardened shell or exoskeleton on exterior surface 118 of woven material 100. With comparison to FIG. 3B, bonding fibers 108 positioned on exterior surface 118, when melted, may form hardened portions of exterior surface 118 of woven material 100, that may be exposed. The hardened, exposed portions of exterior surface 118 may provide increased rigidity to woven material 100. This may be substantially beneficial in tapered portion 28 of woven material 100, which may be formed by increasing the distance between warp threads 102 and ultimately decreasing the fiber density for woven material 100, as discussed herein. The bonds formed within tapered portion 28 of woven material 100 by melting bonding fibers 108 may substantially increase the rigidity or stiffness of woven material 100 at tapered portion 28, and may ultimately minimize or eliminate the negative effects or aspects (e.g., weakening, undesired movement, visual or cosmetic deformation) associated with forming tapered portion 28 within woven material 100, as discussed herein. Additionally, the positioning and subsequently melting of bonding fibers 108 on exterior surface 118 of woven material 100, may allow woven material 100 to be an acceptable material for forming reed loop 26 (see, FIG. 1B), which may require additional strength and rigidity to maintain its shape during use of wearable band 10.

Figure 5:
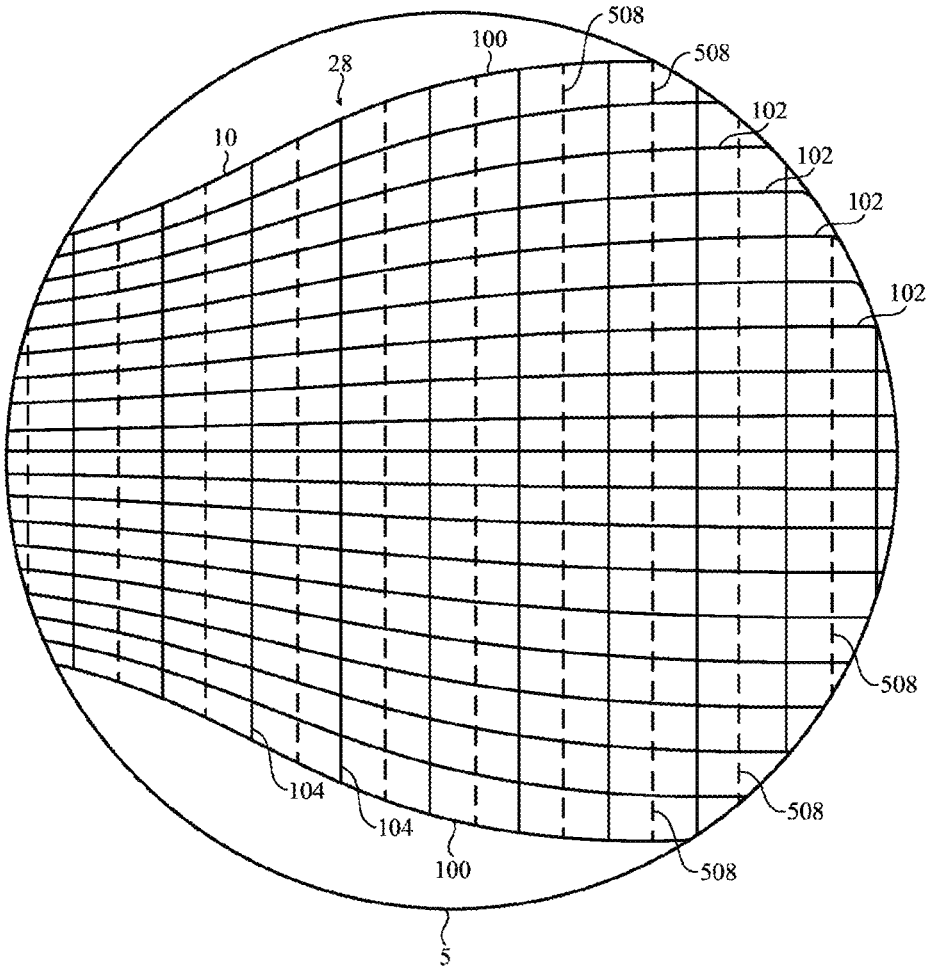
FIG. 5 shows an enlarged tapered portion of the wearable band including woven material as depicted in FIG. 1, according to another embodiment.

FIG. 5 shows an enlarged portion 5 of wearable band 10 including woven material 100, as depicted in FIG. 1. More specifically, and similar to FIG. 2, FIG. 5 shows an enlarged view of tapered portion 28 of wearable band 10 formed from woven material 100 according to an additional embodiment. FIG. 5 depicts distinct features and/or additional embodiments of woven material 100. That is, FIG. 5 depicts the plurality of bonding fibers 508 (shown in phantom) positioned in parallel with the at least one weft thread 104 and/or positioned perpendicular to warp threads 102 in tapered portion 28 of woven material 100 forming wearable band 10. Also distinct from bonding fibers 108 depicted in FIG. 2, and as discussed in detail herein, bonding fibers 508 may be positioned only in a portion of the entire length of wearable band 10 formed from woven material 100. As shown in FIG. 5, bonding fibers 508 may be positioned completely within tapered portion 28 and portions of wearable band 10 positioned directly adjacent to tapered portion 28. Bonding fibers 508 may be formed within woven material 100 in a substantially similar manner and/or using a substantially similar technique as discussed herein with respect to bonding fibers 108 shown in FIGS. 2 and 3A. Additionally, bonding fibers 508 may be formed from substantially similar material as bonding fibers 108 shown in FIGS. 2 and 3A. As such, redundant explanation of these features is omitted for clarity.

Figure 6A:
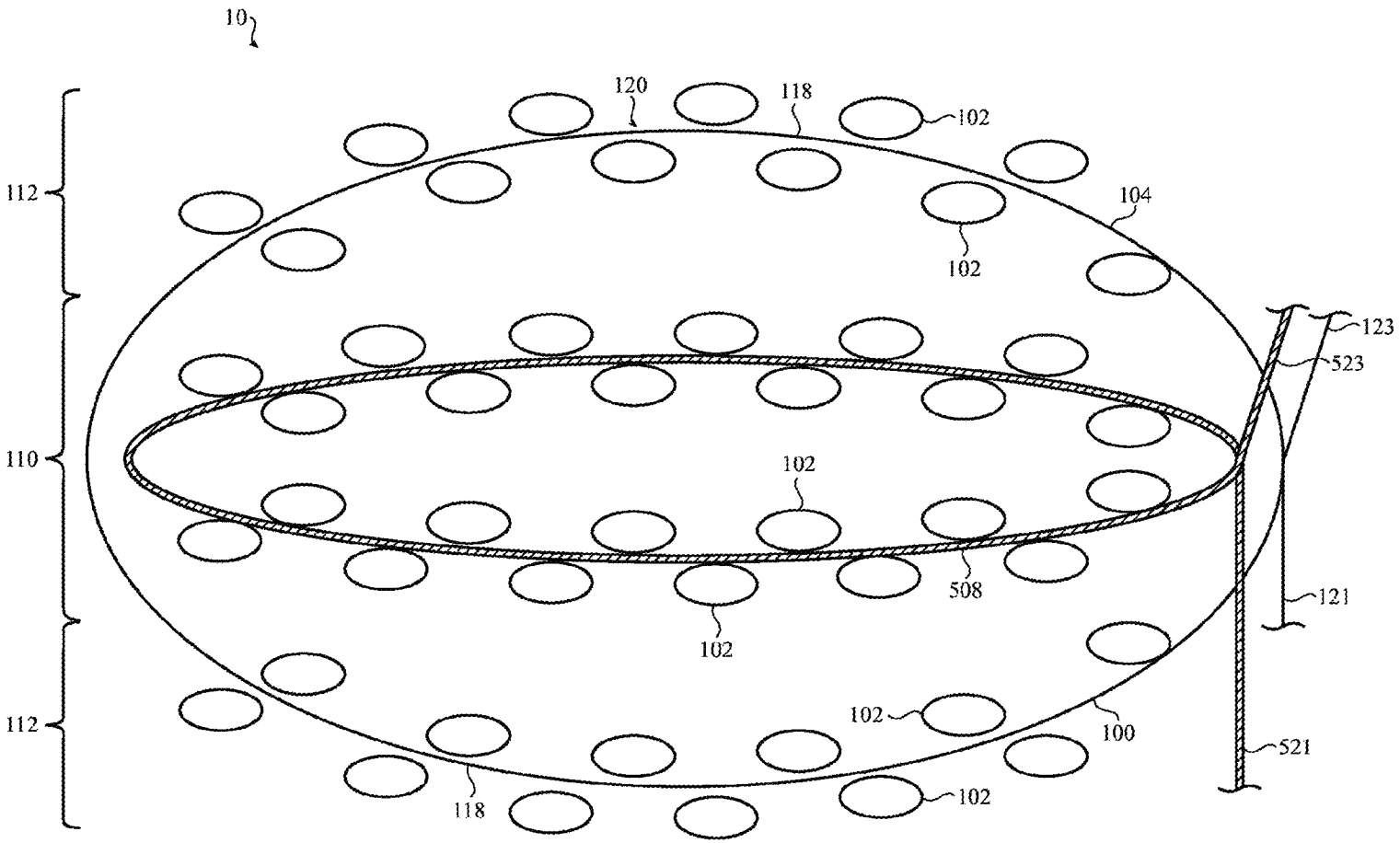
FIG. 6A shows a cross-section view of a portion of the wearable band of FIG. 1 taken along line CS, according to further embodiments.

The plurality of bonding fibers 508 are shown in phantom as a result of bonding fibers 508 being positioned within woven material 100 and/or wearable band 10. That is, and as shown in FIG. 6A, the plurality of bonding fibers 508 may be formed as a weft thread (e.g., weft thread 104), and may be coupled to the plurality of warp threads 102 of woven material 100. As such, bonding fibers 508 may not be visible and/or are not included in the exterior surface 118 of wearable band 10 formed from woven material 100. However, and as discussed herein with respect to FIGS. 7 and 8, the plurality of bonding fibers 508 may be positioned in and/or may be exposed on an exterior surface 118 of woven material 100.

Turning to FIG. 6A, a cross-section view of a portion of wearable band 10 of FIG. 1 taken along line CS is shown according to additional embodiments. More specifically, and distinct from FIG. 3A, FIG. 6A depicts a cross-section view of tapered portion 28 of wearable band 10 formed from woven material 100, where woven material 100 includes bonding fibers 508 positioned in parallel with weft threads 104 and/or perpendicular to warp threads 102. As shown in FIG. 6A, and similarly discussed herein, woven material 100 may include the first group 110 of warp threads 102 which may form an inner portion of woven material 100. Additionally, woven material 100 may include the second group 112 of warp threads 102 substantially surrounding the first group 110 of warp threads 102, where the second group 112 of warp threads 102 form the outer portion or exterior surface 118 of woven material 100. Warp threads 102 and weft threads 104, as shown in FIG. 6A, may be substantially similar to and/or may include substantially similar characteristics as the warp threads 102 and weft threads 104 discussed herein with respect to FIGS. 2 and 3A. For example, warp threads 102 and weft threads 104 may be formed from a material having a melting temperature that is greater than the melting temperature of the material forming the bonding fibers 508. As such, redundant explanation of these features is omitted for clarity.

As shown in FIG. 6A, woven material 100 may include weft thread 104 and bonding fibers 508 coupled to the plurality of warp threads 102. As similarly discussed herein with respect to FIG. 3A, weft thread 104 may include exterior weft thread portion 120 coupled to, woven or interlaced between the second group 112 of warp threads 102. Dissimilar to FIG. 3A, weft thread 104 may not be coupled to the first group 110 of warp threads 102 of woven material 100. That is, as shown in FIG. 6A, bonding fibers 508 (single fiber shown) may be coupled to, woven or interlaced between the second group 112 of warp threads 102, positioned within an inner portion of woven material 100. As a result of bonding fibers 508 being positioned within an inner portion of woven material 100 and/or coupled to the first group 110 of warp threads 102, bonding fibers 508 may not be seen by a user of wearable band 10.

Similar to weft thread 104, as discussed herein with respect to FIG. 3A, bonding fibers 508 positioned in parallel with weft thread 104 of woven material 100 may include prior bonding fiber layer portion 521 and subsequent bonding fiber layer portion 523 positioned opposite prior bonding fiber layer portion 521. Prior bonding fiber layer portion 521 and subsequent bonding fiber layer portion 523 of bonding fibers 508, as shown in FIG. 6A, may function substantially similar to prior layer portion 121 and subsequent layer portion 123 of weft thread 104, as discussed herein. That is, prior bonding fibers layer portion 521 may include a portion of bonding fibers 508 that may be included in the prior layer of woven material 100, and previously woven through the first group 110 of warp threads 102. Conversely, subsequent bonding fibers layer portion 523 of bonding fibers 508 may be woven through the first group 110 of warp threads 102 of the displayed or current layer of woven material 100, and may be positioned to be subsequently woven through the subsequent layer of woven material 100.

As shown in FIG. 6A, weft thread 104 and bonding fibers 508 may be two distinct threads and/or fibers coupled to, woven or interlaced between the first group 110 and the second group 112, respectively, of warp threads 102 in woven material 100. That is, when forming woven material 100, weft thread 104 and bonding fibers 508 may be coupled to the plurality of warp threads 102 using substantially distinct threads, fibers and/or materials. However, it is understood that weft tread 104 and bonding fibers 508 may include a pre-manufactured, single thread or fiber that may be coupled to the plurality of warp threads 102 to form woven material 100. That is, the single thread or fiber forming the weft thread 104 and bonding fibers 508 may include a pre-manufactured thread including alternating portions of material similar to the material forming weft thread 104 and bonding fibers 508, respectively. In this embodiment, the portions of alternating material may include a predetermined length corresponding to the weave pattern and/or process of woven material 100, such that when the single thread or fiber is being woven around the first group 110 of warp threads 102, the material of the single thread corresponds to similar material used to form bonding fibers 508.

Figure 6B:
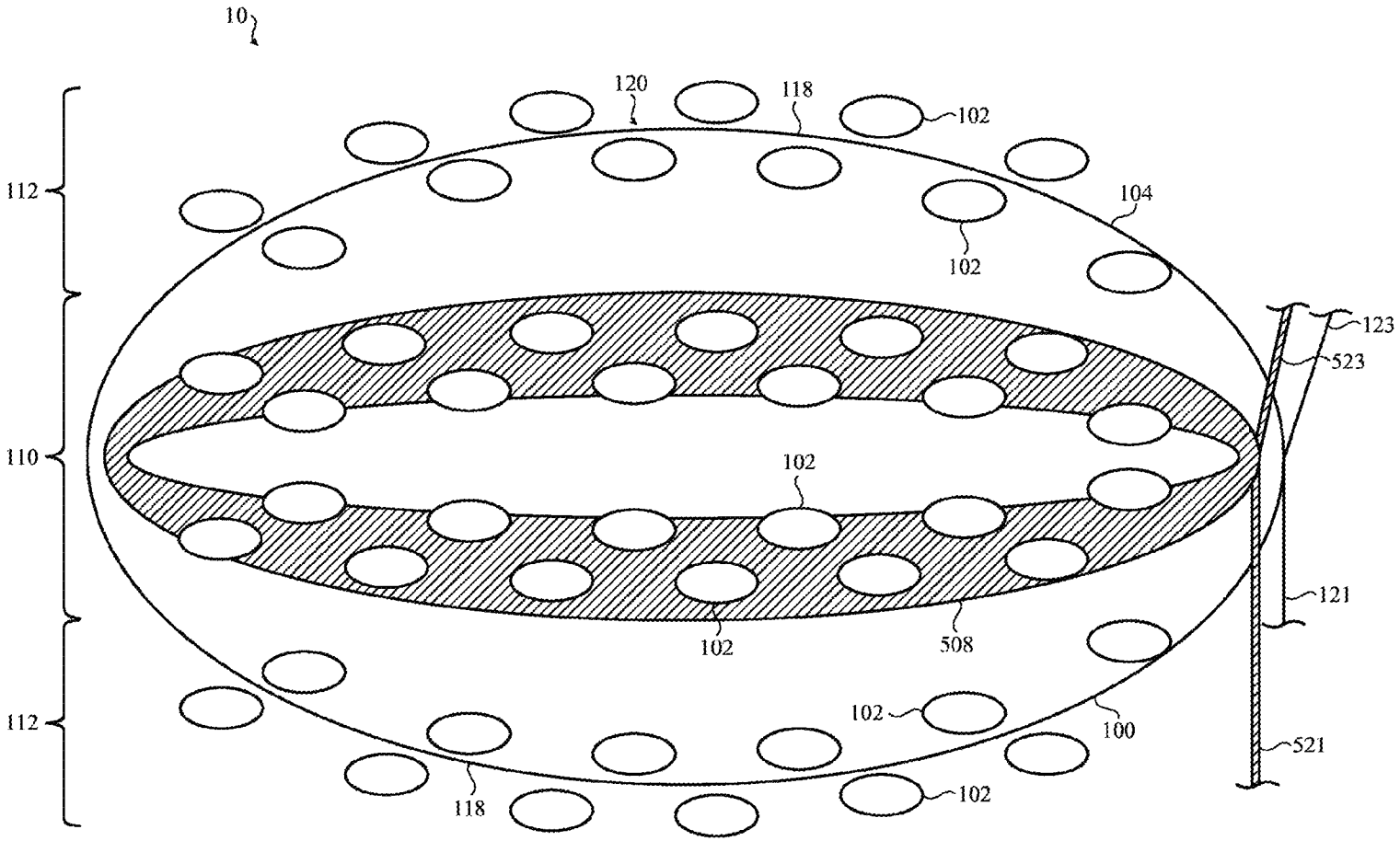
FIG. 6B shows a cross-section view of a portion of the wearable band of FIG. 1 taken along line CS after a melting process is performed, according to further embodiments.

FIG. 6B shows a cross-section view of a portion of the wearable band 10 of FIG. 1 taken along line CS, after a melting process has been performed. As discussed herein, bonding fibers 508 may be substantially melted within woven material 100, and may form a bond between the warp threads 102 and/or weft thread 104 of woven material 100. More specifically, bonding fibers 508 may be melted within woven material 100 to form bonds between the warp threads 102 and/or weft thread 104 of woven material 100, without melting, or more generally, changing the characteristics (e.g., strength, position, state, etc.) of warp threads 102 and weft thread 104. As shown in FIG. 6B, bonding fibers 508 coupled to the first group 110 of warp threads 102 and/or positioned within an inner portion of woven material 100 may be melted to substantially bond first group 110 of warp threads 102 to each other.

Although shown in FIG. 6B as only bonding the first group 110 of warp threads 102, bonding fibers 508 may bond every component of woven material 100. That is, in another embodiment where bonding fibers 508 are coupled to the first group 110 of warp threads 102, the process of melting bonding fibers 508 may result in the formation of a bond between the first group 110 of warp threads 102, the second group 112 of warp threads 102 and/or weft thread 104 coupled to the second group 112 of warp threads 102. As discussed herein, the portion of woven material 100 that may include the bond formed by bonding fibers 508 may be dependent, at least in part, on characteristics of bonding fibers 508 such as, the size/dimensions of bonding fibers 508, the number of bonding fibers 508, the physical/chemical characteristics (e.g., expansion characteristics) of the material forming bonding fibers 508, the exposure time to the external heat source, the temperature of the external heat source, the size/dimensions/quantity/formation of the woven material 100 and its components (e.g., warp threads 102, weft thread 104), etc.

As similarly discussed herein, forming bonds between the components (e.g., warp threads 102, weft thread 104) of woven material 100 by melting bonding fibers 508 may increase stiffness and rigidity in woven material 100. More specifically, by melting bonding fibers 508 formed within tapered portion 28 of woven material 100, as shown in FIGS.

5-6B, the plurality of warp threads 102 and/or the at least one weft thread 104 of woven material may be substantially bonded together, which may result in additional stiffness and/or rigidity for woven material 100 forming wearable band 10.

Figure 7:
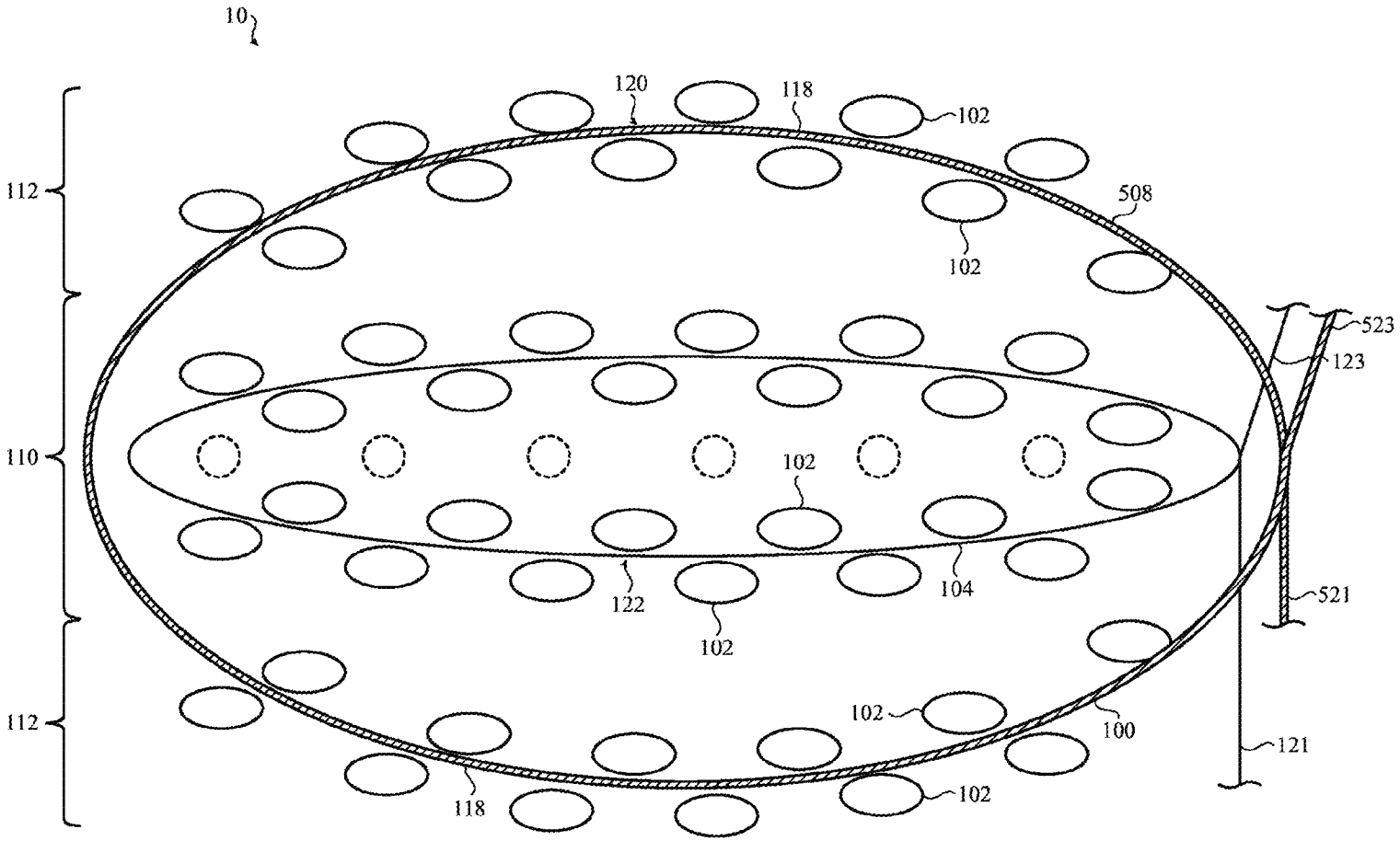
FIG. 7 shows a cross-section view of a portion of the wearable band of FIG. 1 taken along line CS, according to another embodiment.
Figure 8:
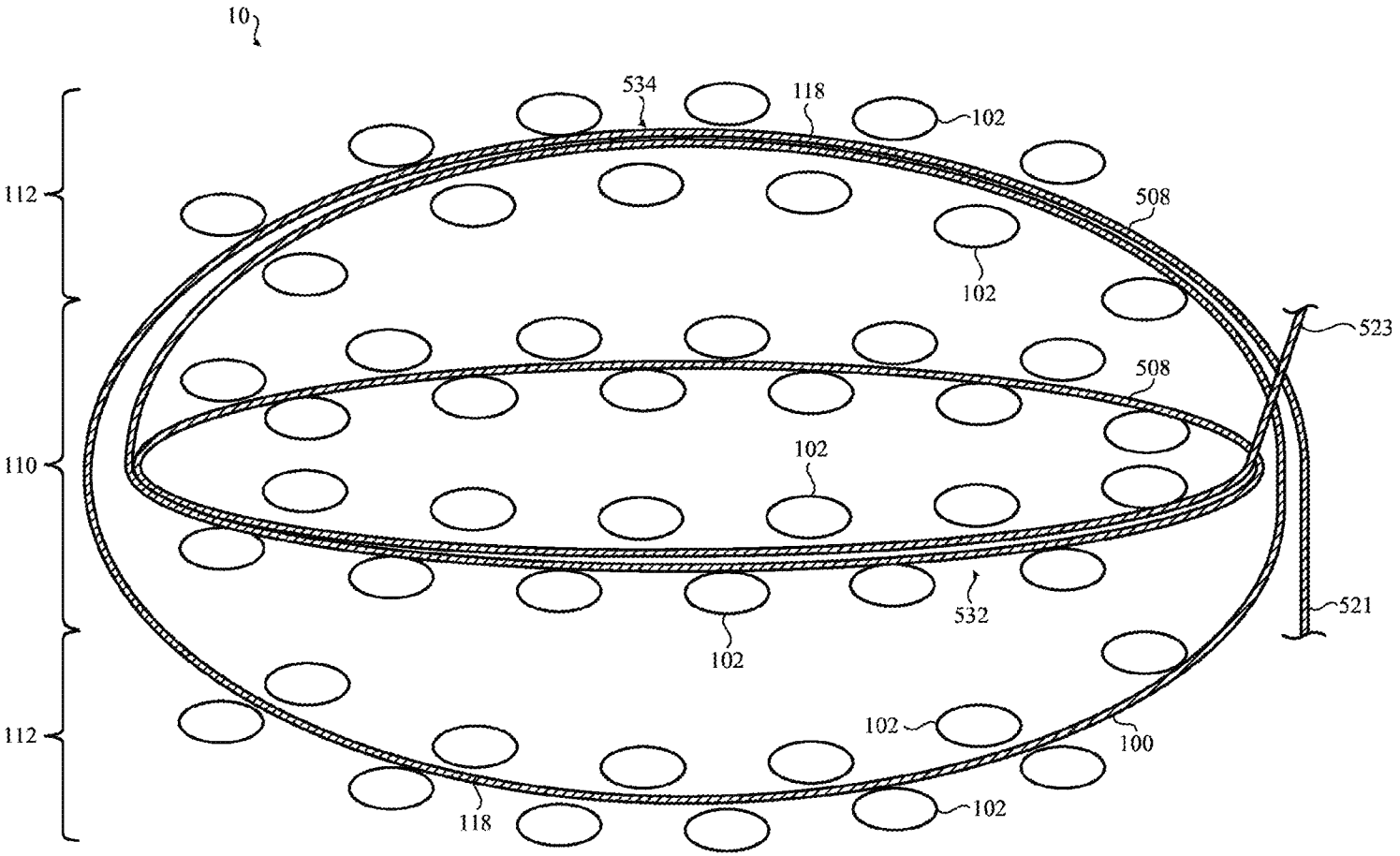
FIG. 8 shows a cross-section view of a portion of the wearable band of FIG. 1 taken along line CS, according to additional embodiments.

FIGS. 7 and 8 show cross-section views of a portion of wearable band 10 of FIG. 1 taken along line CS, according to additional embodiments. As shown in FIGS. 7 and 8, bonding fibers 508 may be positioned parallel to weft thread 104 and perpendicular to the warp threads 102, as similarly discussed herein with respect to FIGS. 5 and 6A. However, FIGS. 7 and 8 may include additional embodiments distinct from one another, and distinct from the woven material 100 shown in FIG. 6A.

As shown in FIG. 7, weft thread 104 may be coupled to inner group 110 of warp threads 102, and may be positioned within an inner portion of woven material 100. Additionally, bonding fibers 508 may be coupled to, woven or interlaced between the second group 112 of warp threads 102 of woven material 100. As a result of coupling bonding fibers 508 to the second group 112 of warp threads 102, bonding fibers 508 may be positioned within an outer portion or exterior surface 118 of woven material 100. As similarly discussed herein with respect to weft thread 104 in FIG. 3A, bonding fibers 508 coupled to the second group 112 of warp thread 102 may be positioned within exterior surface 118 but may be substantially covered by the second group 112 of warp threads and/or may not be visible to a user of wearable band 10. Bonding fibers 508 coupled to the second group 112 of warp threads 102 may be melted to form a bond between the second group 112 of warp threads 102. Additionally, in some instances, bonding fibers 508 may be melted to form a bond between the second group 112 of warp threads 102, the first group 110 of warp threads 102 and/or weft thread 104 coupled to the first group 110 of warp threads 102.

Woven material 100, as shown in FIG. 7, may also include bonding fibers 108 (shown in phantom) positioned in parallel with the plurality of warp threads 102. Bonding fibers 108 positioned in parallel to warp threads 102 may be substantially surrounded by the first group 110 of warp threads 102 and weft thread 104, as similarly discussed herein with respect to FIG. 3A. Additionally, bonding fibers 108 may be positioned within woven material 100 and may include substantially similar material and/or function as similarly discussed herein with respect to the first collection 124 of bonding fibers 108 in FIG. 3A. As such, redundant explanation is omitted herein for clarity.

In another embodiment, as shown in FIG. 8, weft thread 104 (see, FIG. 3A-7) may be completely replaced by bonding fibers 508. More specifically, bonding fibers 508 may be coupled to, woven or interlaced between both the first group 110 and the second group 112 of warp threads 102 for forming woven material 100. As such, a distinct weft thread 104 may not be necessary in forming woven material 100, as shown in the embodiment of FIG. 8. Bonding fibers 508 may include a plurality of bonding fibers coupled to the warp threads 102, or may include a single bonding fiber 508 coupled to warp threads 102, as similarly discussed herein with respect to weft thread 104 of FIG. 3A. Bonding fibers 508 may include an interior bonding fiber portion 532 coupled to the first group 110 of warp threads 102, and an exterior bonding fiber portion 534 coupled to the second group 112 of warp threads 102. When melted, bonding fibers 508 of FIG. 8 may form a bond between warp threads 102. More specifically, interior bonding fiber portion 532 may form a bond between the threads included in the first group 110 of warp threads 102, and exterior bonding fiber portion 534 may form a bond between the threads included in the second group 112 of warp threads 102. Additionally, interior bonding fiber portion 532 and exterior bonding fiber portion 534, separately or together, may form a bond between the first group 110 and the second group 112 of warp threads 102 of woven material 100.

Bonding fibers 508, as shown in FIGS. 7 and 8, respectively, may be melted using any suitable melting technique and may provide increased stiffness and rigidity to woven material 100 forming wearable band 10, as discussed herein.

As discussed herein, bonding fibers 508 may be formed within only a portion of woven material 100. More specifically, where bonding fibers 508 are positioned in parallel to weft thread 104 and/or positioned perpendicular to warp threads 102 of woven material 100, bonding fibers 508 may be selectively positioned in predetermined portions of woven material 100 forming wearable band 10. As discussed herein, portions (e.g., uniform portion 30) may not necessitate the need for increased stiffness and/or rigidity, and therefore woven material 100 forming wearable band 10 may not include bonding fibers 508 in those portions.

Figure 9:
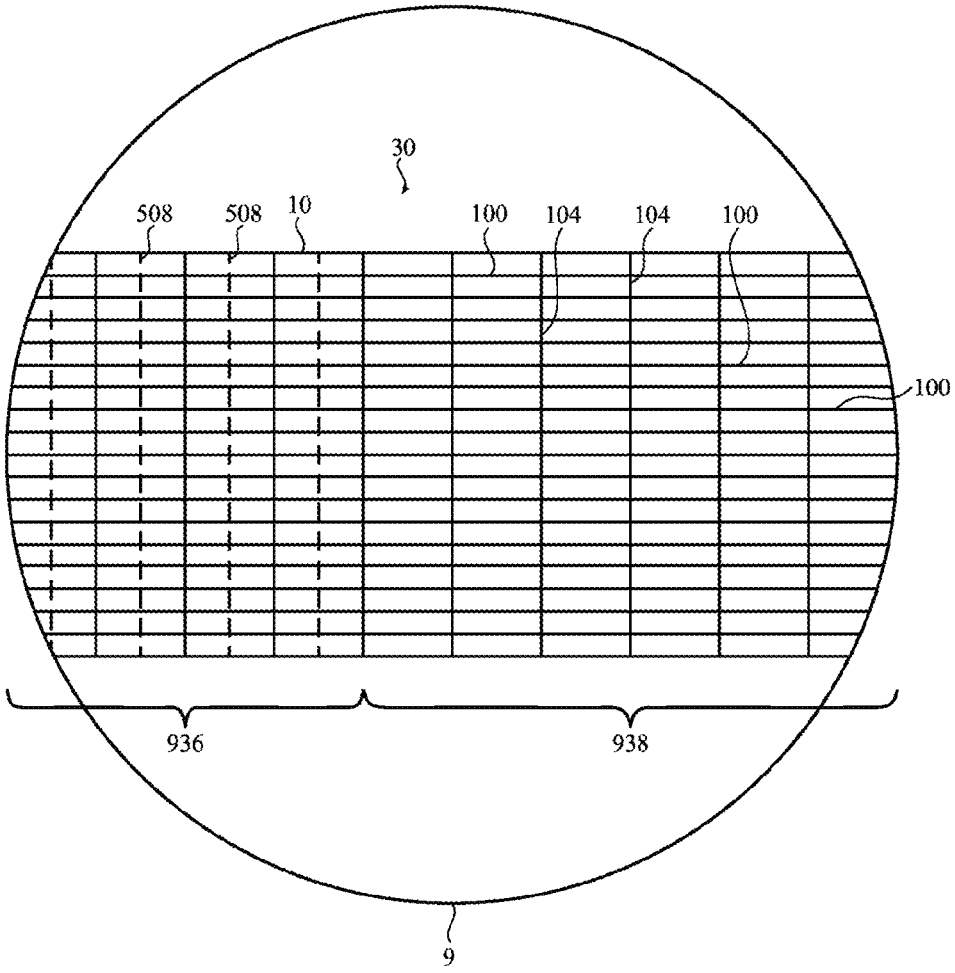
FIG. 9 shows an enlarged uniform portion of the wearable band including woven material as depicted in FIG. 1, according to additional embodiments.

FIG. 9 shows an enlarged portion 9 of wearable band 10 including woven material 100, as depicted in FIG. 1. More specifically, FIG. 9 shows an enlarged view of uniform portion 30 of wearable band 10 formed from woven material 100. As discussed herein woven material 100 of wearable band 10 may include a plurality of warp threads 102, at least one weft thread 104 coupled to the plurality of warp threads 102, and bonding fibers 508 positioned within woven material 100. Similar to FIG. 5, bonding fibers 508, as shown in FIG. 9, may be positioned parallel to weft thread 104 and/or may be positioned perpendicular to the plurality of warp threads 102. However, bonding fibers 508 may only be positioned in a portion of woven material 100. That is, bonding fibers 508 may only be positioned in a first section 936 of uniform portion 30 of wearable band 10 formed from woven material 100. As shown in FIG. 9, and with continued reference to FIG. 1, first section 936 of uniform portion 30 of wearable band 10 may be positioned directly adjacent to tapered portion 28 of wearable band 10. As such, bonding fibers 508 may be included in woven material 100 forming first section 936 of uniform portion 30 of wearable band 10. As discussed herein, bonding fibers 508 including in woven material 100 forming first section 936 of wearable band 10 may be melted and may increase the stiffness and rigidity of woven material 100 forming wearable band 10.

As shown in FIG. 9, a second section 938 of uniform portion 30 of wearable band 10 may not include bonding fibers 508. More specifically, the portion of woven material 100 included in second section 938 of wearable band 10 may not include bonding fibers 508 positioned parallel to weft thread 104. As a result, second section 938 of uniform portion 30 of wearable band 10 may not be exposed to the heat source, and/or may not be provided with an increased stiffness and rigidity from melting bonding fibers 508. As such, where tapered portion 28 of woven material 100 forming wearable band 10, and first section 936 of uniform portion 30 may include increased stiffness and rigidity from melting bonding fibers 508, second section 938 of wearable band 10 may remain substantially unchanged (e.g., maintain stiffness).

Similar to FIG. 2, it is understood that the number of threads shown in FIGS. 3A-9 to form woven material 100 may be merely exemplary. That is, the number of warp threads 102 weft threads 104, and/or bonding fibers 108, 508 shown in FIGS. 3A-9 may be merely exemplary for clearly and completely describing the disclosure, and may not represent the actual number of warp threads 102, weft threads 104 and/or bonding fibers 108, 508 used to form woven material 100. It is also understood, and discussed herein, that reed loop 26 (see, FIG. 1) may be formed from woven material 100. As such, any of the various embodiments of woven material 100 discussed and shown in FIGS. 2-9 may be used to form wearable band 10 and/or reed loop 26 of wearable band 10.

Figure 10:
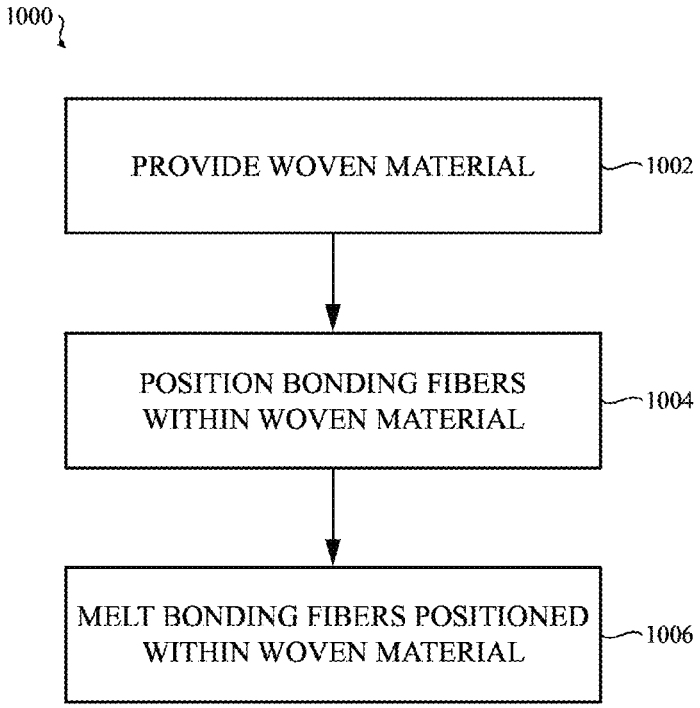
FIG. 10 shows a flow chart illustrating a method of reinforcing a woven material. This method may be performed on the woven material as shown in FIGS. 2-9.

Turning to FIG. 10, a method of reinforcing a woven material 100 (FIGS. 2-9) is now discussed. Specifically, FIG. 10 is a flowchart depicting one sample method 1000 for forming a reinforced woven material, as discussed herein with respect to FIGS. 1-9.

In operation 1002, a woven material may be provided. The provided woven material may include a plurality of warp threads and at least one weft thread coupled to the plurality of warp threads. In an embodiment, the warp threads may include a first group of warp threads positioned within an inner portion of the woven material, and a second group of warp threads substantially surrounding the first group of warp threads. The second group of warp threads may form the outer portion or exterior surface of the woven material. The at least one weft thread may be coupled to both the first group and the second group of warp threads. The woven material including the first group and second group of warp threads may be substantially similar to the woven material discussed herein with respect to FIG. 3A. In another embodiment, the woven material may include the warp threads and weft thread positioned around filler fibers, where the weft thread is coupled to the plurality of warp threads. The woven material including the filler fibers may be substantially similar to the woven material discussed herein with respect to FIG. 4A.

In operation 1004, a plurality of bonding fibers may be positioned within at least a portion of the woven material. More specifically, the plurality of bonding fibers may be woven into the woven material during the formation of the woven material, such that the bonding fibers are positioned within at least a portion of the woven material. The positioning of the plurality of bonding fibers within at least a portion of the woven material may include positioning the plurality of bonding fibers in parallel with the warp threads of the woven material and/or positioning the plurality of bonding fibers in parallel with the weft thread of the woven material. Where the bonding fibers are positioned in parallel with the warp threads, the bonding fibers may be positioned within an entire length of the woven material. Where the bonding fibers are positioned in parallel with the weft thread, the bonding fibers may be positioned within at least a portion of the width of the woven material and/or within at least a portion of the length of the woven material. The bonding fibers may be formed from a material distinct from the material used to form the warp threads and the weft thread of the woven material. Additionally, the material used to form the bonding fibers may include a melting temperature that is lower than the melting temperature of the material forming the warp threads and the weft thread. The positioning of the bonding fibers within the woven material may form a woven material substantially similar to the woven material discussed in FIGS. 2-9.

In operation 1006, the plurality of bonding fibers positioned within at least a portion of the woven material may be melted. That is, the woven material including the plurality of bonding fibers may be exposed to an external heat source, and the bonding fibers positioned within the woven material may be substantially liquefied using the external heat source. By liquefying the bonding fibers positioned within the woven material, liquefied bonding fibers may form a bond between the plurality of warp threads and/or the at least one weft thread of the woven material. That is, the liquefied bonding fibers may form a bond between a group or all of the warp threads and/or may form a bond between a group of the warp threads and the weft thread. To solidify and/or ensure a bond is formed within the woven material using the bonding fibers, the woven material may only be exposed to the external heating source long enough to melt the bonding fibers, but not melt the warp threads or weft threads of the woven material. As such, the exposure of the woven material to the external heating source may be discontinued after the bonding fibers are melted within the woven material. This may allow the liquefied bonding fibers to harden and form bonds to the warp threads and/or the weft thread of the woven material.

By weaving bonding fibers into a woven material, a component formed from the woven material may be reinforced and may be provided with additional or increased stiffness and rigidity. Additionally, where the bonding fibers woven into the woven material are formed from a material having a melting temperature lower than the melting temperature of the material forming the warp and weft threads of the woven material, the bonding fibers may be melted within the woven material without melting the remaining components of the woven material. This may result in maintaining the structural characteristics of the warp and weft threads of the woven material, while simultaneously forming bonds by melting the bonding fibers. Additionally, where the bonding fibers are included within the woven material (e.g., not exposed), the bonds may be formed by melting the bonding fibers without changing the appearance or aesthetics of the woven material. Alternatively, where bonding fibers may be exposed or positioned on an exterior surface of the woven material, the bonding fibers may be formed from a transparent material. As a result, the bonding fibers, formed from the transparent material, may also be melted without changing the appearance or aesthetics of the woven material.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not targeted to be exhaustive or to limit the embodiments to the precise forms disclosed. It will be apparent to one of ordinary skill in the art that many modifications and variations are possible in view of the above teachings.

What is claimed is:

1. A woven watch band comprising:

warp threads;

at least one weft thread coupled to the warp threads, the warp threads and the at least one weft thread forming:

a first uniform portion having a uniform width defined by opposing first edges of the first uniform portion, the first edges extending along a first length of the woven watch band;

a second uniform portion having the uniform width defined by opposing second edges of the second uniform portion, the second edges extending along a second length of the woven watch band; and a tapered portion having a varying width defined by opposing third edges of the tapered portion, the third edges extending along a third length of the woven watch band, the second uniform portion being positioned between the first uniform portion and the tapered portion; and a bond formed between the warp threads and the weft threads from melted bonding fibers positioned within only the second uniform portion and the tapered portion and at least one of:

in parallel with the warp threads, or in parallel with the at least one weft thread.

2. The woven watch band of claim 1, wherein the bonding fibers include a melting temperature lower than a melting temperature of the warp threads.

3. The woven watch band of claim 2, wherein the melting temperature of the bonding fibers is lower than a melting temperature of the at least one weft thread.

4. The woven watch band of claim 1, wherein the bonding fibers include a material selected from the group consisting of polyamide, polyester, polypropylene, and thermoplastic polyurethane.

5. The woven watch band of claim 1, wherein the warp threads includes a material selected from a group consisting of polyamide, polyester, and polypropylene.

6. The woven watch band of claim 1, wherein the at least one weft thread includes a material selected from a group consisting of polyamide, polyester, and polypropylene.

7. The woven watch band of claim 1, wherein the bond is positioned within only a portion of the woven watch band.

8. The woven watch band of claim 1, wherein the bonding fibers are positioned on an exterior surface of the woven watch band.

9. The woven watch band of claim 8, wherein the bonding fibers are transparent.

10. The woven watch band of claim 8, wherein in response to the bonding fibers being positioned in parallel with the warp threads, the at least one weft thread is coupled to the bond.

11. The woven watch band of claim 1, wherein the bonding fibers are surrounded by the warp threads, and wherein the bonding fibers are substantially surrounded by the at least one weft thread coupled to the warp threads.

12. The woven watch band of claim 1, wherein the warp threads further comprise:

a first group of warp threads; and a second group of warp threads surrounding the first group of warp threads.

13. The woven watch band of claim 12, wherein the at least one weft thread further comprises:

an interior weft thread portion coupled to the first group of warp threads; and an exterior weft thread portion coupled to the second group of warp threads.

14. The woven watch band of claim 12, wherein the bonding fibers further comprises at least one of:

a first collection of bonding fibers surrounded by the first group of warp threads, or a second collection of bonding fibers positioned between the first group of warp threads and the second group of warp threads.

15. A method of reinforcing a woven watch band, the method comprising: providing the woven watch band including:

warp threads; and at least one weft thread coupled to the warp threads, the warp threads and the at least one weft thread forming:

a first uniform portion having a uniform width defined by opposing first edges of the first uniform portion, the first edges extending along a first length of the woven watch band;

a second uniform portion having the uniform width defined by opposing second edges of the second uniform portion, the second edges extending along a second length of the woven watch band; and a tapered portion having a varying width defined by opposing third edges of the tapered portion, the third edges extending along a third length of the woven watch band, the second uniform portion being positioned between the first uniform portion and the tapered portion; and positioning bonding fibers within only the second uniform portion and the tapered portion; and melting an entirety of each of the bonding fibers.

16. The method of claim 15, wherein the positioning of the bonding fibers further comprises at least one of:

positioning the bonding fibers in parallel with the warp threads, or positioning the bonding fibers in parallel with the at least one weft thread.

17. The method of claim 16, wherein in response to positioning the bonding fibers in parallel with the at least one weft thread, at least one of:

positioning the bonding fibers within at least a portion of a width of the woven watch band, or positioning the bonding fibers within at least a portion of a length of the woven watch band.

18. The method of claim 15, wherein the melting of the bonding fibers further comprises:

exposing the woven watch band including the bonding fibers to an external heat source;

liquefying only the bonding fibers positioned within the woven watch band using the external heat source;

bonding the liquefied bonding fibers to at least one of:

the warp threads of the woven watch band, or the at least one weft thread of the woven watch band; and discontinuing exposure of the woven watch band to the external heat source to allow the liquefied bonding fibers to harden.

* * * * *